US009368267B2

(12) United States Patent
Viotto et al.

(10) Patent No.: US 9,368,267 B2
(45) Date of Patent: Jun. 14, 2016

(54) DYNAMICALLY BIASED INDUCTOR

(71) Applicant: SMA Solar Technology AG, Niestetal (DE)

(72) Inventors: Michael Viotto, Kassel (DE); Klaus Rigbers, Kassel (DE); Jens Friebe, Vellmar (DE); Peter Zacharias, Kassel (DE)

(73) Assignee: SMA SOLAR TECHNOLOGY AG, Niestetal (DE)

( * ) Notice: Subject to any disclaimer, the term of this patent is extended or adjusted under 35 U.S.C. 154(b) by 47 days.

(21) Appl. No.: 13/975,754

(22) Filed: Aug. 26, 2013

(65) Prior Publication Data

US 2013/0335178 A1 Dec. 19, 2013

Related U.S. Application Data

(63) Continuation of application No. PCT/EP2012/053243, filed on Feb. 27, 2012.

(30) Foreign Application Priority Data

Feb. 28, 2011 (DE) ..... 10 2011 000 980

(51) Int. Cl.
*H01F 21/00* (2006.01)
*H01F 17/06* (2006.01)
(Continued)

(52) U.S. Cl.
CPC ..... *H01F 21/08* (2013.01); *H01F 29/14* (2013.01); *H01F 13/003* (2013.01); *H01F 2003/103* (2013.01)

(58) Field of Classification Search
CPC ..... H01F 21/08; H01F 3/14; H01F 27/245
USPC ..... 336/110, 178, 212
See application file for complete search history.

(56) References Cited

U.S. PATENT DOCUMENTS 2,694,178 A * 11/1954 Smith ..... 323/250
2,722,603 A 11/1955 Dimond
(Continued)

FOREIGN PATENT DOCUMENTS

CA 2279668 A1 2/2000
DE 19924363 A1 3/2000
(Continued)

OTHER PUBLICATIONS

International Search Report & Written Opinion of the International Searching Authority dated May 31, 2012 for International Application No. PCT/EP2012/053243. 14 Pages.

*Primary Examiner* — Tsz Chan
(74) *Attorney, Agent, or Firm* — Eschweiler & Associates, LLC

(57) ABSTRACT

An inductor apparatus includes an inductor winding, a core defining a magnetic circuit for a magnetic flux generated by a current flowing through the inductor winding, at least one permanent magnet magnetically biasing the core by its permanent magnetization, and a magnetization device operable for adjusting a desired magnetization of the permanent magnet. The at least one permanent magnet is arranged within the magnetic circuit of the magnetic flux generated by the current flowing through the inductor winding. The magnetization device includes a magnetization winding and a circuitry configured to subject the magnetization winding to magnetization current pulses, thereby generating at a location of the permanent magnet a magnetic field which is able to change the permanent magnetization of the permanent magnet.

16 Claims, 6 Drawing Sheets

(51) Int. Cl.

| | |
|---|---|
| ***H01F 27/24*** | (2006.01) |
| ***H01F 21/08*** | (2006.01) |
| ***H01F 29/14*** | (2006.01) |
| *H01F 13/00* | (2006.01) |
| *H01F 3/10* | (2006.01) |

(56) References Cited

U.S. PATENT DOCUMENTS

| | | | | |
|---|---|---|---|---|
| 2,781,503 | A | 2/1957 | Saunders | |
| 2,875,952 | A | 3/1959 | Barry | |
| 3,223,917 | A * | 12/1965 | Schweitzer, Jr. | 363/170 |
| 3,519,918 | A * | 7/1970 | Bruck | H01F 21/08 323/330 |
| 4,456,873 | A * | 6/1984 | Schweitzer, Jr. | 324/543 |
| 5,473,299 | A * | 12/1995 | Tsutsumi et al. | 336/110 |
| 5,773,969 | A | 6/1998 | Nakayama et al. | |
| 5,844,786 | A | 12/1998 | Yoshida et al. | |
| 6,362,718 | B1 * | 3/2002 | Patrick et al. | 336/214 |
| 6,639,499 | B2 | 10/2003 | Okita et al. | |
| 6,734,771 | B2 * | 5/2004 | Okita et al. | 335/229 |
| 6,856,231 | B2 | 2/2005 | Fujiwara et al. | |
| 6,995,643 | B2 | 2/2006 | Fujiwara et al. | |
| 7,847,663 | B2 | 12/2010 | Soedoe | |
| 2012/0104979 | A1 * | 5/2012 | Sayre | H01F 6/006 318/130 |

FOREIGN PATENT DOCUMENTS

| | | | |
|---|---|---|---|
| DE | 10259117 | A1 * | 7/2004 |
| EP | 0735657 | A1 | 10/1996 |
| EP | 0793334 | A1 | 9/1997 |
| EP | 1321950 | A1 | 6/2003 |
| EP | 2012327 | A2 | 1/2009 |
| GB | 2415833 | A | 1/2006 |

* cited by examiner

DYNAMICALLY BIASED INDUCTOR

REFERENCE TO RELATED APPLICATIONS

This application is a continuation of International Application Number PCT/EP2012/053243, filed on Feb. 27, 2012, which claims priority to German Application Number 10 2011 000 980.9, filed on Feb. 28, 2011.

FIELD

The disclosure relates to an inductor apparatus comprising an inductor winding, a core and at least one permanent magnet magnetically biasing the core. Further, the disclosure relates to uses of and methods of operating such an inductor apparatus.

Often, such an inductor apparatus is referred to as an inductor coil, a storage inductor or just as an inductor. Such inductors are, for example, used in DC/DC converters, i.e. in boost and buck converters, and in EMC filters for alternating currents output by inverters.

BACKGROUND

The current flowing through the inductor of a switched DC/DC converter displays a ripple at the switching frequency. With regard to its magnetic properties, the inductor is designed such that amperages of the current flowing in normal operation of the DC/DC converter do not saturate its core magnetically. This design aspect determines the minimum size and thus the cost of the inductor. Generally, the operation range of amperages not magnetically saturating the inductor is symmetric with regard to a current of zero ampere and thus independent of the flow direction of the current. The current flowing through the inductor of a DC/DC converter, however, only has one direction. As a result only one half of the usable operation range of its inductor is used. Inductors of DC/DC converters are also referred to as inductors for DC applications or DC inductors here.

It is known to shift the operation range of an inductor apparatus by means of placing a permanent magnet into its magnetic circuit that is defined by its core. Particularly, the magnetic field of the permanent magnet is oriented in an opposite direction to the magnetization which is generated by the direct current flowing through the inductor winding. This measure is referred to as pre- or bias-magnetization or as (magnetically) biasing the inductor. By means of this measure, the magnetic field generated by the direct current is at least partially compensated, and the full operation range of the inductor can be used. This means that the inductor may be made considerably smaller and of considerably less material at an unchanged high efficiency. Thus a cost advantage is achieved as compared to inductors without bias magnetization.

However, there is a considerable risk that even a high-quality permanent magnet loses its magnetization if it is subjected to high temperatures and/or if the field strength of a magnetic field generated by the inductor winding and having a direction opposite to the magnetization of the permanent magnet becomes too high, i.e. higher than the so-called intrinsic coercive field strength of the permanent magnet at the respective temperature. As a result, the level of pre-magnetization may be changed in a disadvantageous way locally or even over the entire inductor apparatus. Such high magnetic field strengths usually do not occur during normal operation of an inductor apparatus, but they may occur under extreme operating conditions. Further, the behavior of the magnetization of a permanent magnet subjected to a magnetic field generated by a current through the inductor winding modulated at a high frequency, particularly in an inductor of a boost converter, is not predictable, and it could have a negative influence on the magnetization of the permanent magnet even if an absolute value of the field strength of such a high-frequency magnetic field is acceptable.

A boost converter comprising an inductor apparatus which includes a permanent magnet in its magnetic circuit is known from EP 0 735 657 B1. A core of the inductor apparatus is magnetically biased by means of a permanent magnet generating a bias magnetization in an direction opposite to the magnetization which is generated by a pulsed direct current flowing through the inductor winding in operation of the boost converter. This allows for use of a comparatively small inductor apparatus as compared to the maximum amperage of the pulsed direct current.

A further inductor apparatus comprising a permanent magnet in its magnetic circuit is known from EP 1 321 950 A1. This document relates to the material requirements which the permanent magnet should fulfill in order to yield both a reduction in volume and an increase in efficiency by implementing a pre-magnetization of the core.

From EP 2 012 327 A2 an inductor apparatus comprising a permanent magnet in its magnetic circuit is known in which the magnetic flux through its core is increased by orienting the permanent magnet at a slant angle. The purpose of this arrangement is to enable the use of plastic-bonded, easily machinable magnet materials for pre-magnetising the core, although they do not comply with certain magnetic requirements. Further, it is exploited that due to their low electrical conductivity no eddy currents are generated in these materials even if subjected to a magnetic field oriented at a right angle to the permanent magnet.

U.S. Pat. No. 6,639,499 B2 describes how to select a geometric arrangement which avoids de-magnetization of the permanent magnet in a magnetic circuit of an inductor apparatus under all conceivable operation conditions of the inductor apparatus. This selection shall allow for using permanent magnets of materials of comparatively low intrinsic coercive field strength. However, no conventional core shapes can be used here, as the center limb of the core has to be longer than the outer limbs.

AT 215 023 B discloses an apparatus for adjusting the inductance of at least one inductor winding arranged on a core made of a magnetically soft, ferromagnetic material. The magnetically soft core is magnetically coupled to at least one further core made of a permanently magnetic material. The magnetic coupling results in a pre-magnetization of the magnetically soft core which in turn has an influence on the inductance of the inductor winding. This influence is adjustable by means of a magnetization winding arranged on the permanently magnetic core. This magnetization winding may be subjected to magnetising or de-magnetising pulses affecting the magnetization of the permanently magnetic core and thus the pre-magnetization of the magnetically soft core. Due to the coupling of the permanently magnetic core to the magnetically soft core, a pre-magnetization of the magnetically soft core results which always reduces the threshold amperage of the current flowing through the inductor winding, i.e. the amperage at which the magnetically soft core is magnetically saturated, independently of the direction of the current through the inductor winding and independently of the direction or orientation of the magnetization of the permanently magnetic core. The apparatus known from AT 215 023 B is used to tune the resonance inductance of a resonance circuit of a receiver for radio or television signals. An inductor used in such a resonance circuit is not subjected to a power current as high as such currents usually occurring in a DC/DC converter or in an EMC filter.

There still is a need for an inductor apparatus suitable for a power current in which a bias magnetization of its core may be used to a maximum extent under various operation conditions to reduce the size of the inductor and thus its cost of production.

SUMMARY

The inductor apparatus of the present disclosure comprises a magnetization device for adjusting a desired magnetization of a permanent magnet magnetically biasing a magnetic core of the inductor apparatus. The permanent magnet is located in the magnetic circuit of the magnetic flux generated by current flowing through the inductor winding. This magnetic circuit is defined by the magnetically soft core on which the inductor winding is wound. The magnetization device comprises a magnetization winding and a circuitry for subjecting the magnetization winding to magnetization current pulses.

In the inductor apparatus according to the present disclosure the permanent magnetization of the permanent magnet is adjusted during operation of the inductor apparatus. Due to the location of the permanent magnet in the magnetic circuit defined by the magnetic core, the permanent magnet shifts the operation range of the inductor apparatus, i.e. the range of currents through the inductor winding which will not cause a magnetic saturation of the magnetically soft core.

The adjustment of the magnetization of the permanent magnet may be used to restore a desired maximum magnetization of the permanent magnet, or to set the magnetization to a target value depending on the DC current presently flowing through the inductor winding of the inductor apparatus, or to purposefully change the direction of the magnetization of the permanent magnet. The change of the direction of the magnetization of the permanent magnet may be carried out dependent on the time curve of an alternating current flowing through the inductor apparatus such that the direction of the magnetization of the permanent magnet is adapted according to the current flow direction for each half-wave of the alternating current. For this purpose, the magnetization winding may be subjected to magnetization current pulses of high amperage generated by the circuitry. The maximum amperage of these magnetization current pulses typically exceeds the amperage of the currents flowing through the inductor winding in the normal operation of the inductor apparatus, particularly if the intrinsic coercive field strength is to be purposefully exceeded in the area of the permanent magnet for changing the direction of its magnetization. Due to the dynamic adjustment of the magnetization of the permanent magnets, the permanent magnet in the inductor apparatus of the present disclosure may be made of materials which—due to their comparatively low intrinsic coercive field strength—may in principle not be well suited as permanent magnets for magnetically biasing a magnetic core. This allows for an additional cost reduction adding to the reduction in volume of the inductor. These advantages outweigh the efforts to be spent for realising the magnetization device of the inductor apparatus of the present disclosure.

The new inductor apparatus does not necessarily have a separate and additional magnetization winding besides the inductor winding. Instead, the inductor winding itself or a part thereof may be used as the magnetization winding for adjusting the magnetization of the permanent magnet.

Particularly, a common part of the magnetization winding and the inductor winding may be that part of the inductor winding which encloses the permanent magnet. This part of the inductor winding will then be selectively subjected to the magnetization current pulses. The other parts of the inductor winding not belonging to the magnetization winding may be short-circuited by the circuitry when the magnetization winding is subjected to the magnetization current pulses, such that the magnetic field which is generated by subjecting the magnetization winding to the magnetization current pulses is focussed to the area of the permanent magnet. This focussing effect is due to the fact that a magnetic counter-field which is generated by the current induced in the short-circuited parts of the inductor winding repels the magnetic field created by the current pulses through the magnetization winding out of the areas of the magnetic core adjacent to the permanent magnet.

Vice versa, the magnetization winding may also comprise at least one part which does not belong to the inductor winding. This part of the magnetization winding may cooperate with the inductor winding upon adjusting the desired magnetization of the permanent magnet in that a field strength needed for adjusting a desired magnetization by increasing the present magnetization or changing the direction of the present magnetization is achieved when current flows through both the magnetization winding and the inductor winding. However, it is also possible to have a magnetization winding which is separated from the inductor winding, and to adjust the magnetization of the permanent magnet by subjecting the separate magnetization winding to the magnetization current pulses.

When the magnetization winding comprises at least one part which does not belong to the inductor winding, this part of the magnetization winding is, in one embodiment, wound in such a way that the magnetization current pulses flowing through it do not induce a voltage in the inductor winding. For this purpose, the part of the magnetization winding which does not belong to the inductor winding may be wound around another core, i.e. not around the core which defines the magnetic circuit for the inductor winding.

In one embodiment the circuitry for subjecting the magnetization winding to the magnetization current pulses comprises a storage element for electric charge, for example, a capacitor, out of which electric charge is drawn and used to subjects the magnetization winding to the magnetization current pulses. If the inductor device is part of a DC/DC converter, the circuitry may, for example, draw electric charge from a capacitor of an output side voltage link for generating the magnetization current pulses through the magnetization winding. If the inductor winding is part of a boost converter, the circuitry may connect an output side voltage link of the boost converter via the magnetization winding to an input side voltage link of the boost converter. Thus, besides ohmic losses, the electric energy used for generating the magnetization current pulses is not lost. The electric charge only flows from the output side voltage link back to the input side voltage link.

It has already been mentioned that, in the inductor apparatus according to the present disclosure, the material of the permanent magnet, due to the dynamic adjustment of its magnetization, may be selected from a greater group of materials as compared to in magnetically biased inductors without dynamic bias adjustment. This means that less expensive permanent magnets may be used than they would normally be used in magnetically biased inductors since the magnetization of the latter needs not to be stable over a long period of time of many years even under difficult conditions. A permanent magnet having a lower intrinsic coercive field strength additionally has the advantage that its magnetization may be adjusted as desired by means of lower field strengths, i.e. by magnetization current pulses of lower amperage.

In one embodiment the inductor apparatus according to the present disclosure, besides the magnetization device, also comprises a magnetization determining device for determining the present magnetization of the permanent magnet. By means of this determination, it may for example be noticed when it is necessary to purposefully change or refresh the magnetization of the permanent magnet.

The magnetization determining device may, for example, evaluate the time curve of a current flowing through the inductor winding, which may be determined anyway for other reasons. From this time curve, it is noticeable whether the inductor apparatus already reaches a saturation which should not be reached at the respective current. Then the time has come to adjust or correct the magnetization of the permanent magnet.

For simply refreshing the magnetization of the permanent magnet it is sufficient that the magnetization device subjects the magnetization winding to magnetization current pulses of a certain minimum amperage in a fixed current flow direction. If, however, the magnetization of the permanent magnet is purposefully reduced or inverted, the current flow direction of the magnetization current pulses is variable. For adjusting certain magnetizations, it is necessary that the magnetization device subjects the magnetization winding to magnetization current pulses of a defined maximum amperage, because it is the maximum amperage of the magnetization current pulses through the magnetization winding which determines the resulting maximum magnetic field strength at the location of the permanent magnet which in turn determines the magnetization of the permanent magnet after adjustment. Further, if the magnetization of the permanent magnet is higher than it is to be adjusted, it is at first necessary to remove this higher than desired magnetization by a magnetization current pulse which generates a magnetic field having an opposite direction and a magnetic field strength above the intrinsic coercive field strength of the permanent magnet.

The magnetization device of the new inductor apparatus may adjust the magnetization of the permanent magnet depending on an average current through the inductor winding in order to optimize the inductor for this average current with regard to the efficiency of the inductor apparatus. This means, for example, that with an average direct current which is reduced with regard to the maximum direct current, the magnetization of the permanent magnet and thus the magnetic bias of the core are also reduced correspondingly. This adaptation to the average current through the inductor winding may be made within a very short time. In an extreme case, the magnetization device changes a direction of the magnetization of the permanent magnet with each half-wave and thus at twice the frequency of an alternating current flowing through the inductor winding. In this way it becomes possible to use a magnetically biased inductor only having one inductor winding for an alternating current but to nevertheless fully facilitate the advantage of volume reduction which may be associated with such a magnetic bias. The option of changing the direction of the pre-magnetization of the inductor may advantageously also be used in cases where a direct current changes its flow direction at longer intervals of time, like for example the current through an inductor at a battery end of a of a bidirectional DC-DC converter as part of e.g. a battery inverter.

Advantageous developments of the disclosure result from the claims, the description and the drawings. The advantages of features and of combinations of a plurality of features mentioned at the beginning of the description only serve as examples and may be used alternatively or cumulatively without the necessity of embodiments according to the disclosure having to obtain these advantages. Without changing the scope of protection as defined by the enclosed claims, the following applies with respect to the disclosure of the original application and the patent: further features may be taken from the drawings, in particular from the illustrated designs and the dimensions of a plurality of components with respect to one another as well as from their relative arrangement and their operative connection. The combination of features of different embodiments of the disclosure or of features of different claims independent of the chosen references of the claims is also possible, and it is motivated herewith. This also relates to features which are illustrated in separate drawings, or which are mentioned when describing them. These features may also be combined with features of different claims. Furthermore, it is possible that further embodiments of the disclosure do not have the features mentioned in the claims.

BRIEF DESCRIPTION OF THE DRAWINGS

In the following, the disclosure will be further explained and described by means of embodiment examples and with reference to the attached drawings.

DETAILED DESCRIPTION

Figure 1:
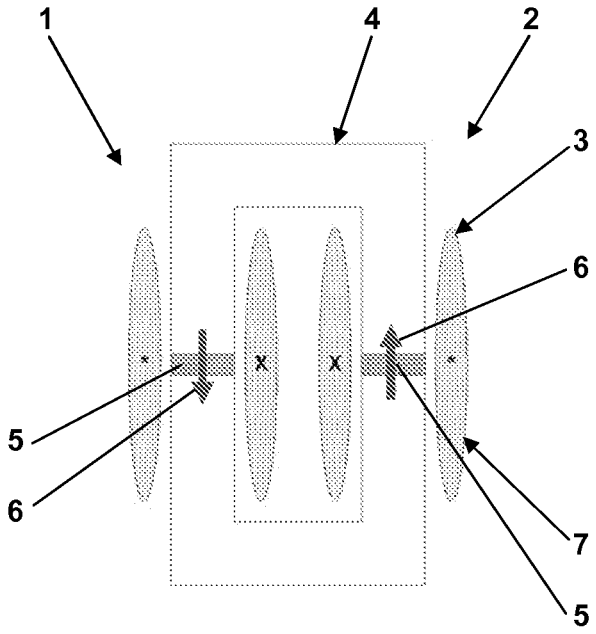
FIG. 1 shows a first embodiment of an inductor winding, of a magnetization winding, of a core and of a permanent magnet of an inductor apparatus according to the present disclosure.

FIG. 1 shows the magnetic circuit 1 of an inductor apparatus 2 which corresponds to the prior art with regard to the components as actually depicted here. The inductor apparatus 2 comprises an inductor winding 3 arranged on a core 4 which is formed as a UU core. Between each pair of opposing free ends of the limbs of the U-shaped partial cores one permanent magnet 5 is arranged for pre-magnetising or magnetically biasing the magnetically soft core 4. The direction of the magnetization of the permanent magnets 5 is indicated by arrows 6. The direction of these magnetizations is opposite to the direction of a magnetization of the core 4 induced by a direct current flowing through the inductor winding 3 whose current ripple is to be reduced by the inductor apparatus 2. In this way, the operation range of the inductor apparatus 2 in which no saturation of the magnetization of the core 4 occurs is shifted in the direction of higher amperages of the current which in this embodiment only flows in one direction through the inductor winding 3. This shift gets lost if the magnetization of the permanent magnets 5 decreases or completely vanishes due to the influence of temperature, high amperages of the current flowing through the inductor winding 3 which exceed its normal operation range, or high-frequency components of the current flowing through the inductor winding 3. For restoration of their magnetization, the permanent magnets 5 are subjected to a magnetic field which exceeds their intrinsic magnetization field strength by means of the inductor winding 2. In the embodiment according to FIG. 1, a magnetization device uses the inductor winding 3 as a magnetization winding 7 which by means of a circuitry not depicted here is subjected to one or several magnetization current pulses. These magnetization current pulses have a current flow direction opposite to the direction of the direct current normally flowing through the inductor winding 3. The maximum amperage of these magnetization current pulses defines the magnetization field strength which acts upon the permanent magnets 5, and thus the level of restoration of the magnetization of the permanent magnets 5.

By means of suitably selecting the material of the permanent magnets 5, not only a desired magnetization of the permanent magnets 5 may be restored by the magnetization current pulses, but also an adjustment resulting in different levels of magnetization is possible. Such an adjustment of the magnetizations of the permanent magnets 5 may be used to adjust the operation range of the inductor apparatus 2 with regard to the average value of the direct current presently flowing through the inductor winding 3. For example, a maximum shift of this operation range which is suitable at high currents through the inductor winding 3 results in unnecessary efficiency losses at low currents. The optimum operation point of the inductor apparatus is at that point, where the pre-magnetization of the core 4 by the permanent magnets 5 is just compensated for by the magnetization induced by the average direct current through the inductor winding 3, i.e. at the point of symmetry of the effective magnetization curve of the core. For example, in case the current through the inductor winding varies between zero and its maximum value, the optimum operation point is located at half the maximum value of the current flowing through the inductor winding 3.

Figure 13:
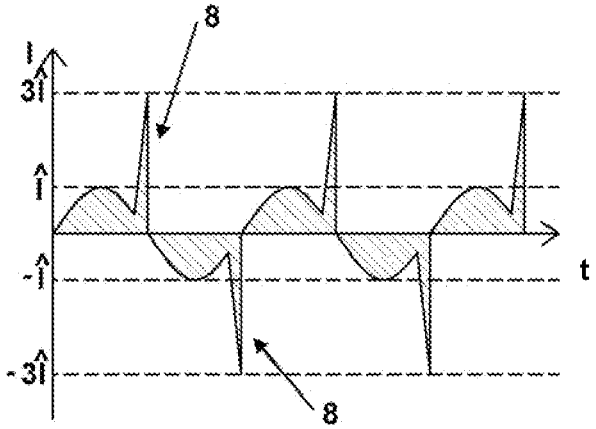
FIG. 13 shows an example of a time curve of an alternating current through the inductor winding of an embodiment of the inductor apparatus according to the present disclosure, in which the inductor winding also serves as a magnetization winding.

This principle can be extended up to inverting the direction of magnetizations of the permanent magnets 5 with each change of the current flow direction between two half-waves of an alternating current flowing through the inductor winding 3. FIG. 13 illustrates the time curve of an alternating current through the inductor winding 3 which also serves as the magnetization winding 7 by which this inversion of the direction of the magnetizations of the permanent magnets 5 may be realised. At the end of each half-wave, the current I for a short time increases up to a multitude of the peak value of the normal alternating current and thus forms a magnetization current pulse 8 and an according pulsed magnetic field with a field strength which exceeds the intrinsic coercive field strength of the permanent magnets 5 and the directions of their magnetizations are inverted for the next half-wave of the alternating current. Thus, the operation range of the inductor apparatus 2 is always optimized for the respective following half-wave of the alternating current. In this way, the size of the inductor apparatus 2, particularly of its magnetic circuit 1, may be reduced to about half the size of an inductor apparatus without permanent magnets whose magnetizations are dynamically inverted.

Figure 2:
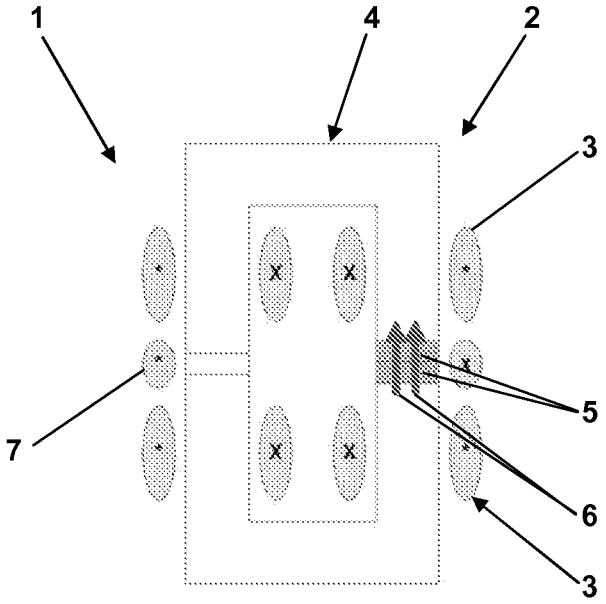
FIG. 2 shows a second embodiment of the same components of the inductor apparatus according to the present disclosure, which are also depicted in FIG. 1.

FIG. 2 shows an embodiment of the inductor apparatus 2 in which the magnetization winding 7 is provided separately from the inductor winding 3 and which is made in such a way that voltages induced by the magnetization current pulses through the magnetization winding 7 are internally compensated in the inductor winding 3. To achieve this goal, the magnetization winding 7 runs around the outside of the limbs of the UU core 4 only. Correspondingly, the two permanent magnets 5 are arranged between the opposing free ends of one pair of the limbs of the U partial cores only, as the magnetization current pulse may adjust the magnetization of the permanent magnets 5 in one absolute direction only. In the arrangement according to FIG. 1 the directions of magnetization of the permanent magnets 5 necessarily point in opposite directions and could thus not be adjusted with the magnetization winding according to FIG. 2. Thus, the arrangement of FIG. 2 does not comprise a permanent magnet between the other pair of opposing limbs of the U partial cores. However, a permanent magnet whose magnetization is not or not to the same extent changed by the magnetization device because it has a higher coercive field strength may be arranged between these other limbs.

Figure 3:
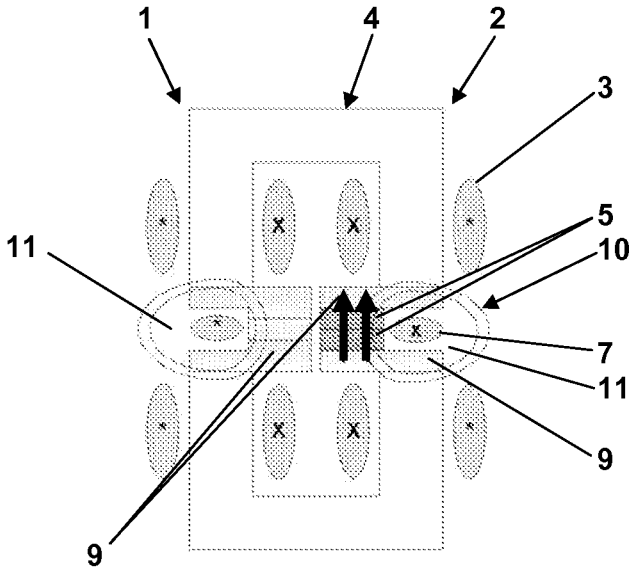
FIG. 3 shows a third embodiment of the same components of the inductor apparatus according to the present disclosure, which are also depicted in FIG. 1.

FIG. 3 shows an embodiment of the inductor apparatus 2 having an advantageous geometric form of the core 4 in the area of the permanent magnets 5 and in the area of the magnetization winding 7 which in this embodiment still is separate from the inductor winding 3. Adjacent to the permanent magnets 5 the magnetic circuit 1 is made of pieces 9 having a higher saturation field strength, which for example a nanocrystalline material has. In this way, an own magnetic circuit 10 is formed for the magnetization winding 7. This magnetic circuit extends outwardly over air gaps 11. With a normal current through the inductor winding 3 this additional magnetic circuit 10 is not of relevance. With the magnetization current pulses which exceed the saturation of the core 4, however, it becomes operative.

Figure 4:
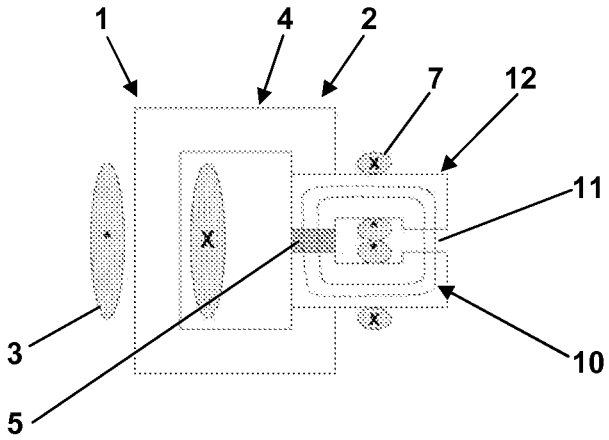
FIG. 4 shows a further embodiment of the same components of the inductor apparatus according to the present disclosure, which are also depicted in FIG. 1.

Such a separate magnetic circuit 10 for the magnetization winding 7 is also formed in the embodiment of the inductor apparatus 2 according to FIG. 4. Here, even an own core 12 is provided for the magnetization winding 7 which overlaps with the core 4 for defining the magnetic circuit 1 for the inductor winding 3 in which the permanent magnet 5 is located.

Figure 5:
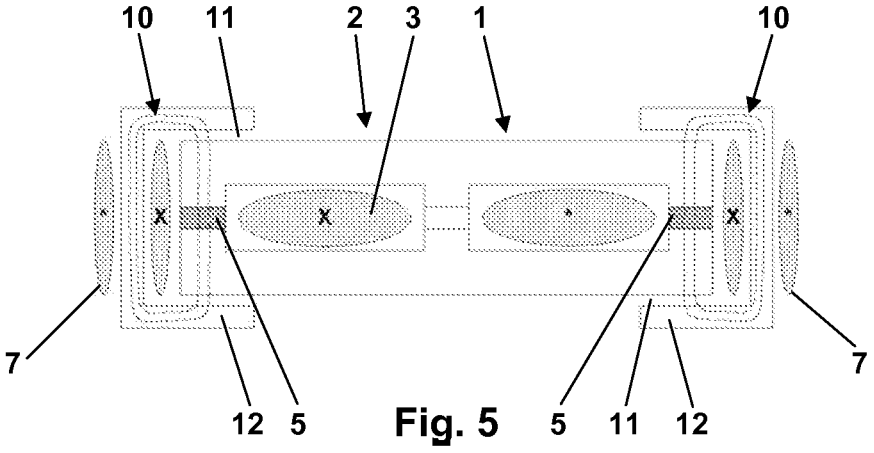
FIG. 5 shows an even further embodiment of the same components of the inductor apparatus according to the present disclosure, which are also depicted in FIG. 1.

In the embodiment of the inductor apparatus 2 according to FIG. 5 this concept is applied in a modified form using a core 1 formed as an EE core. The additional parts of two cores 12 for two magnetization windings 7 each magnetising one permanent magnet 5 are formed as U-shaped partial cores here.

Figure 6:
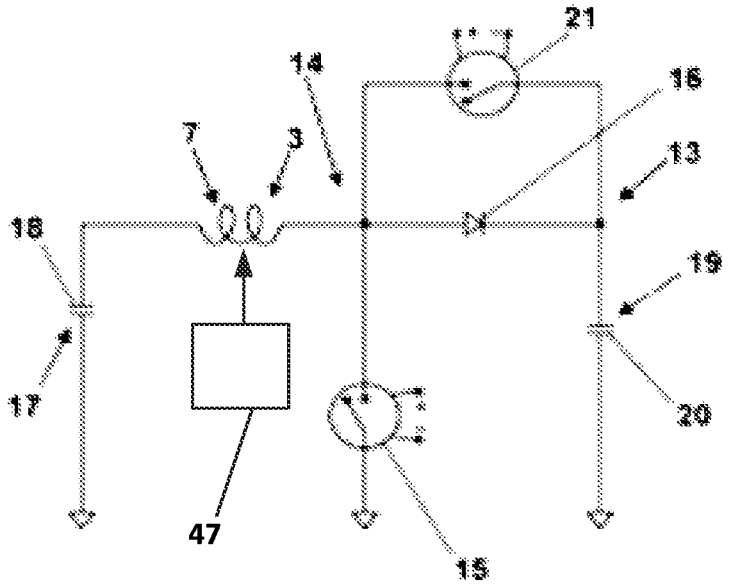
FIG. 6 shows a first embodiment of a circuitry of a magnetization device of the inductor apparatus according to the present disclosure.

FIG. 6 shows a circuitry 13 which basically realizes a boost converter 14 comprising the inductor winding 3, a switch 15 and a diode 16 between an input side DC voltage link 17 including a capacitor 18 and an output side DC voltage link 19 including a capacitor 20. Further, the circuitry 13 comprises an additional switch 21, which is connected in parallel to the diode 16 and which is closed to allow a current to flow from the capacitor 20 through the inductor winding 3, which also serves as the magnetization winding 7 here, into the capacitor 18, i.e. in an direction opposite to the usual working direction of the boost converter 14, for forming a magnetization current pulse. With such a current pulse having a suitable amplitude, the magnetization of the permanent magnets 5 is refreshed in an inductor apparatus 2 according to FIG. 1. The electric charge which, for this purpose, flows through the magnetization winding 7 also serving as the inductor winding 3 is not lost, because it gets back into the input side link 17. The current flow of the magnetization current pulses is here driven by the voltage difference between the input side DC voltage link 17 and the output side DC voltage link 19 of the boost convertor 14. The circuitry 13 further comprises a magnetization determining device 47, configured to determine the magnetization of the permanent magnet 5. The magnetization determining device 47 is configured to evaluate a time curve of the current flowing through the inductor winding 3.

Figure 7:
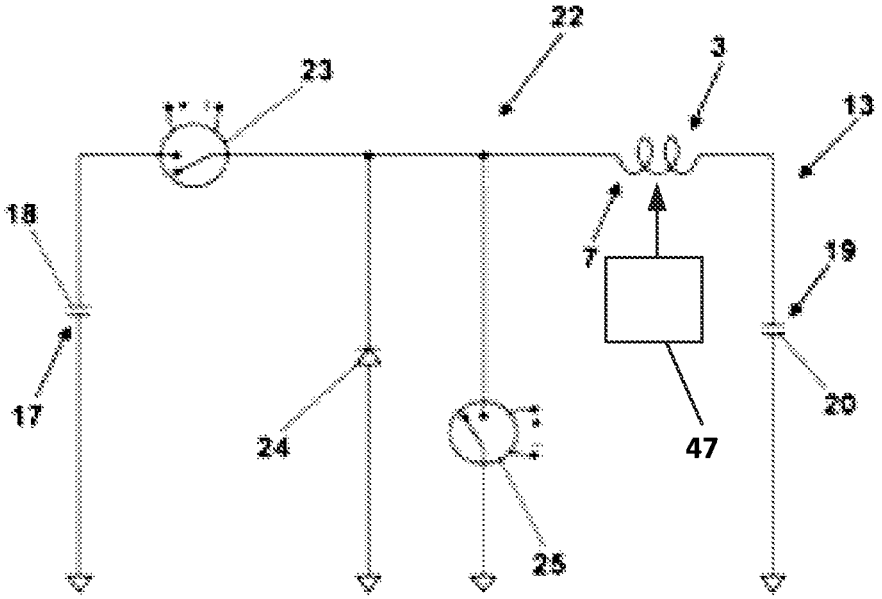
FIG. 7 shows a second embodiment of the circuitry of the magnetization device of the inductor apparatus according to the present disclosure.

The circuitry 13 according to FIG. 7 basically is a circuitry of a buck converter 22 comprising a switch 23, a diode 24 and the inductor winding 3 between the input side DC voltage link 17 and the output side DC voltage link 19. Additionally, a switch 25 is provided here, by which the capacitor 20 of the output side link may be short-circuited via the magnetization winding 7 also serving as the inductor winding 3, in order to generate the magnetization current pulses through the magnetization winding 7. The circuitry 13 according to FIG. 7 also comprises a magnetization determining device 47, configured to determine the magnetization of the permanent magnet 5.

Figure 8:
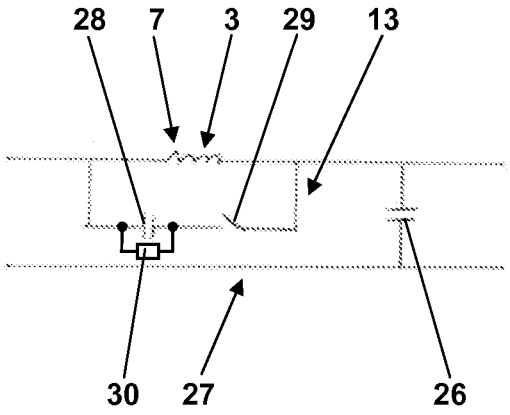
FIG. 8 shows a further embodiment of the circuitry of the magnetization device of the inductor apparatus according to the present disclosure.

If an inductor apparatus is connected to the output of a controllable AC current source, like for example an inductor apparatus serving as an LC filter at the output of an inverter bridge, a magnetization current pulse 8 may be directly generated by controlling the AC voltage source accordingly, particularly by suitably operating the switches of the inverter bridge. FIG. 8 illustrates circuitry 13 according to one embodiment to generate magnetization current pulses through the magnetization winding 7 or inductor winding 3 which, together with an output side capacitor 26 forms an LC filter 27 here. The magnetization winding 7 is connected in parallel to a series connection of a capacitor 28 and a switch 29. The capacitor 28 is charged by an external voltage source 30 and de-charged for generating the magnetization current pulses through the magnetization winding 7 by closing the switch 29. In this way, the output of the LC filter 27 is not subjected to the magnetization current pulses. The circuitry 13 as illustrated here may also be used in DC/DC converters like the boost converter 14 according to FIG. 6 or the buck converter 22 according to FIG. 7, and it is of particular advantage if the magnetization winding 7 is separate from the inductor winding 3.

Figure 9:
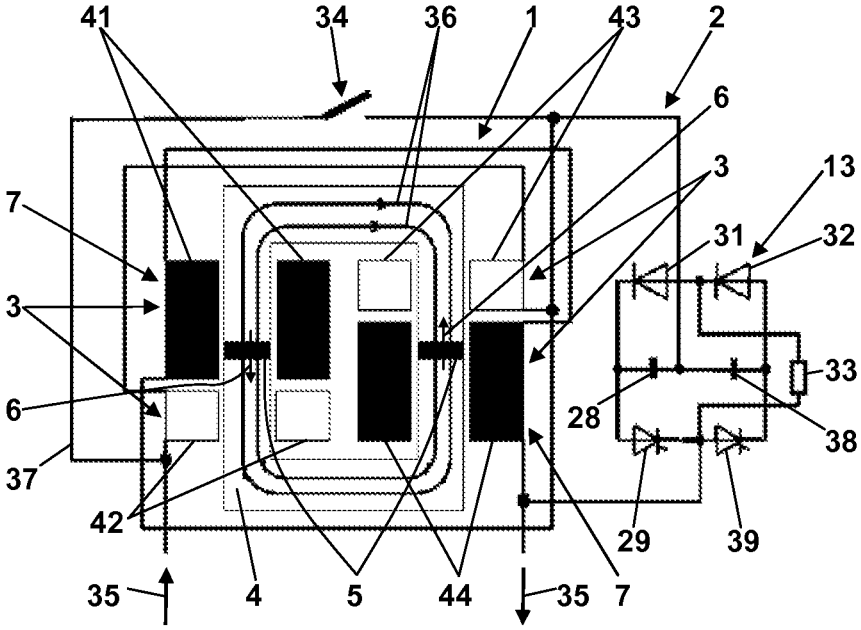
FIG. 9 shows an even further embodiment of the inductor apparatus according to the present disclosure which is designed for an alternating current, wherein magnetic flux lines are depicted which result in normal operation of the inductor apparatus.
Figure 10:
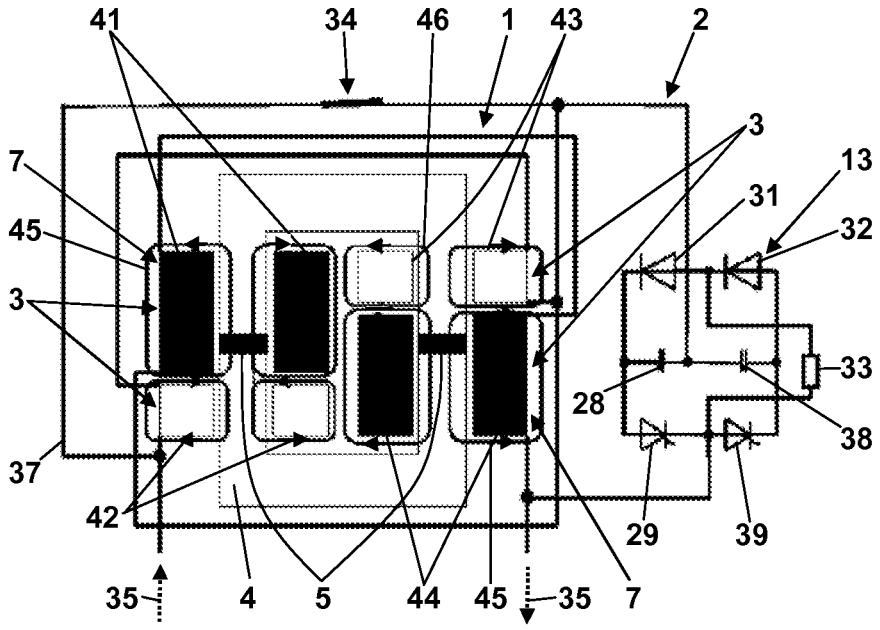
FIG. 10 shows the embodiment of the inductor apparatus according to FIG. 9, wherein magnetic flux lines are depicted which result in a magnetization adjustment operation.
Figure 11:
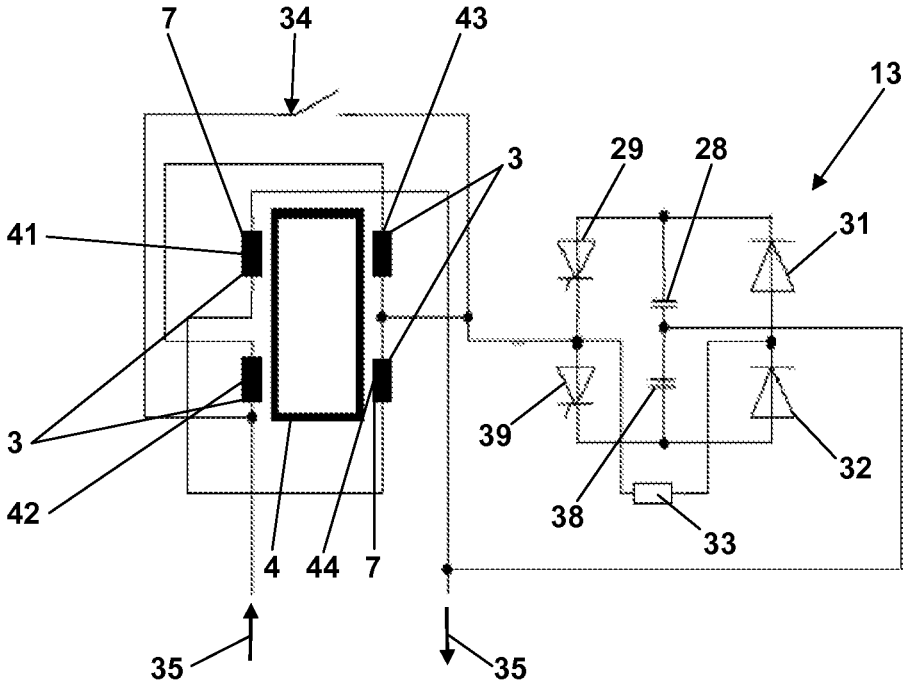
FIG. 11 shows an electric equivalent circuit diagram of the inductor apparatus according to FIGS. 9 and 10.

The inductor apparatus 2 depicted in FIGS. 9 to 11 is provided for a main current 35 of a changing current flow direction, i.e. for an alternating current. During normal operation of the inductor apparatus 2 this main current results in a magnetic field in the core 4 having the magnetic flux lines 36 which are depicted in FIG. 9. The field direction indicated by arrow tips here corresponds to the flow direction of the main current 35 also indicated by arrow tips. The inductor winding 3 is divided into four partial windings 41 to 44 here, through which the main current 35 flows in the order 42, 43, 41 and 44 (or vice versa, respectively). In the magnetization operation according to FIG. 10, only the parts 41 and 44 serve as the magnetization winding, whereas a short-circuiting line 37 is provided which short-circuits the parts 42 and 43 of the inductor winding 3, if a short-circuiting switch 34 arranged in the short-circuiting line 37 is closed. This short-circuiting is done to concentrate the magnetic field resulting from subjecting the parts 41 and 44 to the magnetization current pulses by the circuitry 13 to the permanent magnets 5. This concentration is based on the fact that the magnetization current pulses through the parts 41 and 44 generate a magnetic field which induces currents within the short-circuited parts 42 and 43 of the inductor winding. These currents within the short-circuited parts 42 and 43 generate a counter-field which displaces the inducing magnetic field out of the parts of the core 4 enclosed by the parts 42 and 43 of the inductor winding. The resulting lines of magnetic flux 45 around the parts 41 and 44 of the magnetization winding and the lines of magnetic flux 46 around the parts 42 and 43 of the inductor winding 3 are shown in FIG. 10.

FIGS. 9 to 11 also depict details of the circuitry 13 which subjects the magnetization winding 7 to the magnetization current pulses. The circuitry 13 comprises two capacitors 28 and 38 here, which are charged via a common resistor 33 and a diode 31 and 32, respectively, by an alternating current which is taken from a tap between the parts 43 and 41. Via switches 29 and 39 which are realized using thyristors here, but which may also be realised using other devices providing the same functionality, the capacitors 28 and 38 are alternatingly de-charged through the parts 41 and 44 of the magnetization winding 7 and thereby magnetize the permanent magnets 5 alternatingly in opposite directions so that the inductor apparatus 2 is always prepared for the next half-wave of the alternating current due to the pre-magnetization of its core 4 by means of the two permanent magnets 5. The resistor 33 via which the capacitors 28 and 38 are loaded is optional, at least when working currents or nominal powers of the inductor apparatus 3 are small. Thus, the ohmic losses occurring in the resistor 33 may be avoided. In the embodiment of the inductor apparatus 2 according to FIGS. 9 to 11 the entire winding on the core 4 is used as the inductor winding 3. Nevertheless, in subjecting the parts 41 and 44 of the inductor winding to the magnetization current pulses and in that the further parts 42 and 43 of the inductor winding are short-circuited at the same time, the resulting magnetic field is, to a maximum extent, focused to the permanent magnets 5 whose magnetizations are to be changed.

Figure 12:
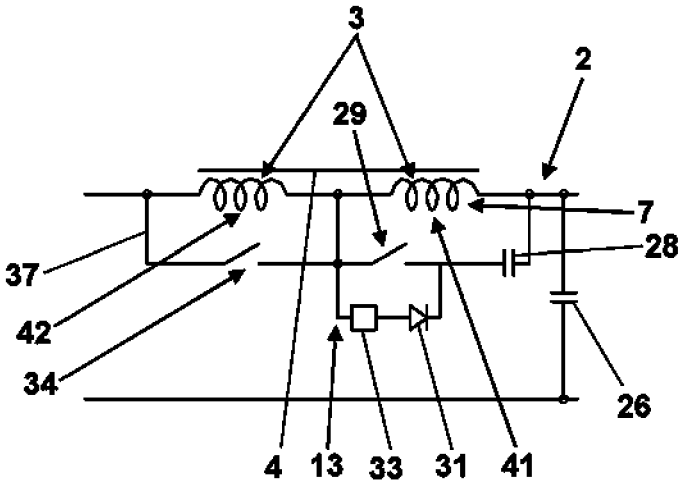
FIG. 12 shows an electric equivalent circuit diagram of a further embodiment of the inductor apparatus according to the present disclosure which is simplified as compared to the embodiment according to FIGS. 9 to 11.

The concept which is provided in FIGS. 9 to 11 for an inductor apparatus 2 and which may be used with an alternating current in which a change of the direction of the magnetization of the permanent magnets 5 occurs between the half-waves of the alternating current flowing as the main current may also be applied to an inductor apparatus 2 for a (pulsed) direct current. This is illustrated in FIG. 12. Here, an inductor winding 3 is divided in two parts 41 and 42 of which, for a change of the magnetization of a permanent magnet arranged in the area of the part 41, the part 42 is short-circuited via closing a short-circuiting switch 34 in the short-circuiting line 37, whereas a capacitor 28 which has been loaded in the meantime via a resistor 33 and a diode 32 is de-charged by closing the switch 29 to generate a magnetization current pulse through the part 41 serving as the magnetization winding 7.

In that, in the embodiment of the inductor apparatus 2 according to FIG. 12, the magnetic field which is generated by the magnetization current pulse is focused to the permanent magnet, a smaller amperage of the magnetization current pulse as compared to the embodiment according to FIG. 8 is sufficient to exceed the intrinsic coercive field strength of the permanent magnet 5. Correspondingly, the capacitor 28 may be dimensioned smaller. This is a general advantage of all embodiments of the inductor apparatus 2 according to the present disclosure depicted in FIGS. 9 to 12.

A magnetization determining device which determines the magnetization of the permanent magnet(s) of the inductor apparatus is not depicted in the figures. Such a magnetization determining device, however, may easily be realized by monitoring the time curve of a current through the inductor winding and looking for indications of an undesired saturation of the core, like for example for an unexpected increase or drop of the current. If, due to the occurrence of such indications, it is noticed that the magnetization of the permanent magnet declined or is no longer suitable for other reasons, a magnetization current pulse through the magnetization winding is triggered. The amperage of this magnetization current pulse may be adjusted according to what magnetization level of the permanent magnet shall be adjusted. If, for this purpose, a higher magnetization has to be removed, a de-magnetization current pulse through the magnetization winding may be necessary which precedes the actual magnetization current pulse. Such a de-magnetization current pulse comprises a current flow direction opposite to the current flow direction of the succeeding magnetization current pulse.

The invention claimed is:

1. An inductor apparatus, comprising:

an inductor winding;

a core defining a magnetic circuit for a magnetic flux generated by a current flowing through the inductor winding;

at least one permanent magnet magnetically biasing the core by its permanent magnetization;

a magnetization device configured to adjust a desired magnetization of the permanent magnet, the magnetization device including:

a magnetization winding comprising at least a portion of the inductor winding; and a circuitry configured to subject the magnetization winding to magnetization current pulses, wherein the magnetization current pulses generate, at a location of the permanent magnet, a magnetic field which changes the permanent magnetization of the permanent magnet, wherein the at least one permanent magnet is arranged within the magnetic circuit of the magnetic flux generated by the current flowing through the inductor winding, and wherein at least one part of the inductor winding that is not part of the magnetization winding is short-circuited by the circuitry upon subjecting the magnetization winding to the magnetization current pulses.

2. The inductor apparatus of claim 1, wherein the magnetization winding is a portion of the inductor winding enclosing the permanent magnet.

3. The inductor apparatus of claim 2, wherein the magnetization winding comprises at least one part that does not belong to the inductor winding.

4. The inductor apparatus of claim 3, wherein the part of the magnetization winding that does not belong to the inductor winding is wound in such a way that the magnetization current pulses flowing therethrough does not induce a voltage in the inductor winding.

5. The inductor apparatus of claim 3, wherein the part of the magnetization winding that does not belong to the inductor winding is not wound around the core.

6. The inductor apparatus of claim 1, further comprising a magnetization determining device configured to determine the magnetization of the permanent magnet.

7. The inductor apparatus of claim 6, wherein the magnetization determining device is configured to evaluate a time curve of a current flowing through the inductor winding.

8. The inductor apparatus of claim 1, wherein the magnetization device is configured to subject the magnetization winding to magnetization current pulses having a defined maximum amperage.

9. The inductor apparatus of claim 1, wherein the magnetization device is configured to subject the magnetization winding to magnetization current pulses of variable current flow direction.

10. The inductor apparatus of claim 1, wherein the magnetization device is configured to adjust the magnetization of the permanent magnet depending on an average current through the inductor winding.

11. The inductor apparatus of claim 1, wherein the magnetization device is configured to change a direction of the magnetization of the permanent magnet.

12. The inductor apparatus of claim 11, wherein the magnetization device is configured to change the direction of the magnetization of the permanent magnet at twice the frequency of an alternating current flowing through the inductor winding.

13. The inductor apparatus of claim 12, wherein the magnetization device is configured to adjust a magnitude of the magnetization of the permanent magnets depending on a peak value of the alternating current flowing through the inductor winding.

14. The inductor apparatus of claim 1, wherein the circuitry is configured to subject the magnetization winding to a magnetization current pulse upon each start of operation of the inductor apparatus or in response to a notice by determining the present magnetization of the at least one permanent magnet.

15. The inductor apparatus of claim 1, wherein the circuitry further comprises a first storage for electric charge configured to output the electric charge as the magnetization current pulse to the magnetization winding.

16. The inductor apparatus of claim 15, wherein the circuitry further comprises:

a second storage for electric charge configured to collect the magnetization current pulse coming through the magnetization winding.

* * * * *